United States Patent [19]

Tullos

[11] 4,368,581

[45] Jan. 18, 1983

[54] BOW SIGHT

[75] Inventor: Charles E. Tullos, Swartz, La.

[73] Assignees: Stanley R. Palowsky, Jr.; Clifford L. Lawrence, both of Monroe, La. ; part interest to each

[21] Appl. No.: 256,737

[22] Filed: Apr. 23, 1981

[51] Int. Cl.[3] ..... F41G 1/46

[52] U.S. Cl. ..... 33/265; 33/283; 33/334; 33/398

[58] Field of Search ..... 33/265, 275 R, 291, 33/334, 398, 283

[56] References Cited

U.S. PATENT DOCUMENTS

| | | | |
|---|---|---|---|
| 2,925,656 | 2/1960 | Genovese | 33/265 |
| 3,013,336 | 12/1961 | Pennington | 33/265 |
| 3,212,190 | 10/1965 | Larson | 33/265 |
| 3,279,071 | 10/1966 | Bilyeu et al. | 33/265 |
| 3,718,979 | 3/1973 | Allen | 33/265 |
| 4,120,096 | 10/1978 | Keller | 33/265 |

*Primary Examiner*—William D. Martin, Jr.

*Attorney, Agent, or Firm*—Brady, O'Boyle & Gates

[57] ABSTRACT

A sight for hunting bows possesses an automatic range finding capability when the hunter is stationed at an elevated position and is infinitely adjustable and lockable to facilitate ground level hunting. A greater range of adjustability enables the sight to function properly on various sizes of bows and with various arrow shaft lengths and weights rather than with only a single bow and arrow combination. Greater simplicity of construction of the bow sight is also achieved.

7 Claims, 6 Drawing Figures

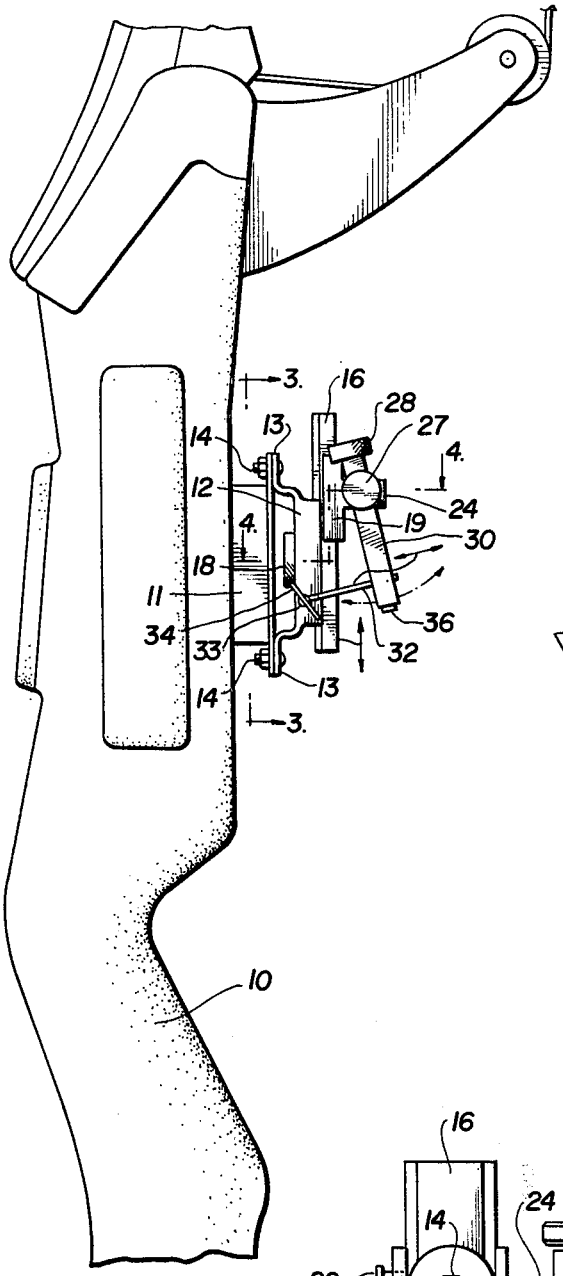
FIG.1
FIG.2
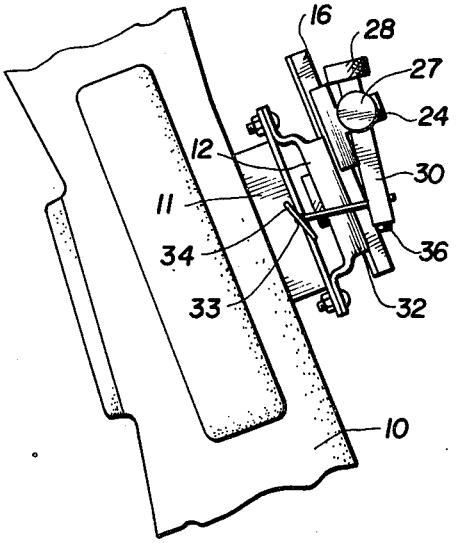
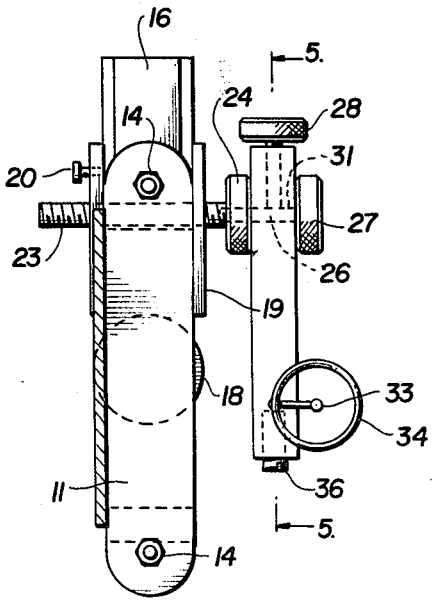
FIG.3

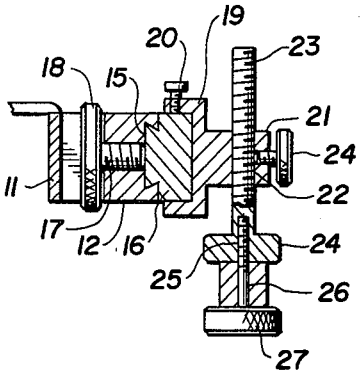
FIG.4
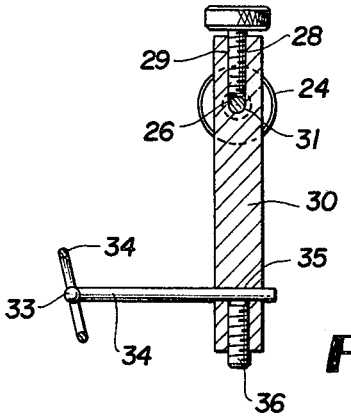
FIG.5
FIG.6
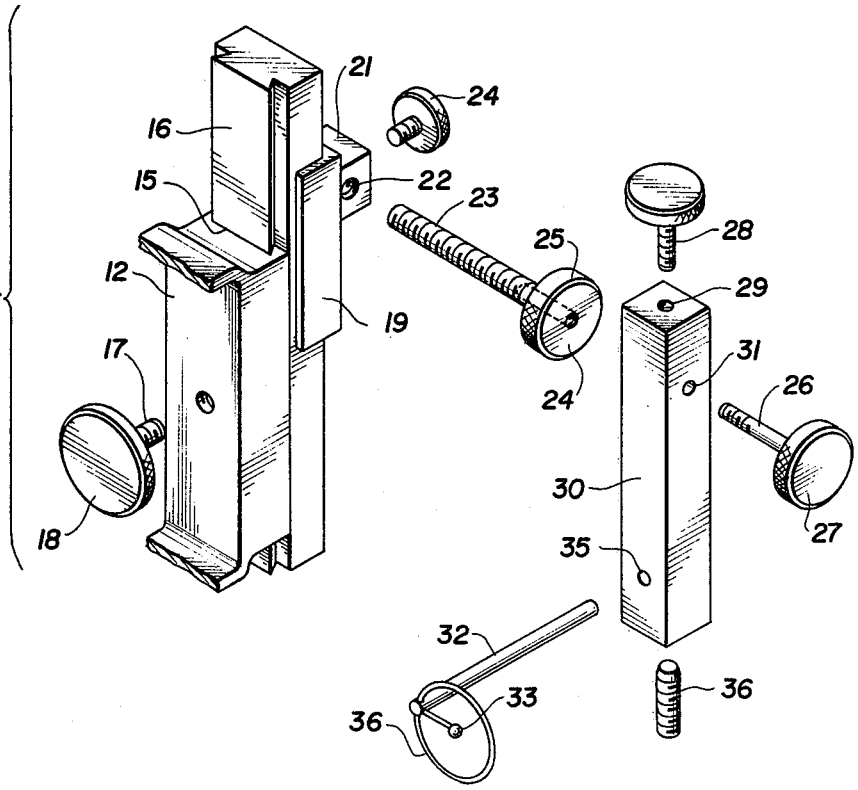

BOW SIGHT

BACKGROUND OF THE INVENTION

A number of adjustable and lockable fixed bead bow sights are known in the prior art, and two examples of such sights are contained in U.S. Pat. Nos. 3,477,130 and 4,224,741. While these prior art adjustable bow sights are suitable for ground level hunting or shooting, they completely lack automatic range finding capability and therefore when employed for hunting from an elevated position require estimating of the range or guesswork by the hunter.

U.S. Pat. No. 4,120,096 discloses a bow sight which has range finding capability when used at an elevated position and also can be locked for usage in ground level shooting. However, the bow sight in this latter patent has several serious drawbacks, the most important of which is the inability of the bow sight to be adjusted for satisfactory use with various sizes of bows and various arrow shaft lengths and weights. This inability stems from the fact that the patented bow sight lacks any adjustment of the radial or automatic swing arc distance from the sight bead to the axis of rotation of the gravity activated pivoted mass carrying the sight bead or beads.

A major aim of the present invention is, therefore, to improve on an automatic range finding bow sight of the class shown in U.S. Pat. No. 4,120,096 through provision of a sight bead which is adjustably mounted on the pivoted mass in such a way that the effective radius and center of gravity of the mass relative to the axis of rotation of the pivoted mass may be infinitely varied, thus enabling the bow sight to be used on a wide range of bow sizes and with different arrow lengths and weights.

A further drawback of the bow sight in U.S. Pat. No. 4,120,096 which the present invention seeks to eliminate is the restricted range of rotational adjustability and locking of the rotational mass. In the present invention, the rotational mass carrying the independently adjustable sight bead can be adjusted through an infinite range circumferentially with respect to its rotational axis and can be locked in an infinite number of positions around said axis.

A further objective fully achieved by the invention is a substantial simplifying of the construction of the range finding bow sight compared to the construction of the bow sight in U.S. Pat. No. 4,120,096, thus rendering it more practical, more convenient to use, and comparatively less expensive to manufacture.

Other features and advantages of the invention will become apparent during the course of the following detailed description.

BRIEF DESCRIPTION OF THE DRAWINGS

FIG. 1 is a fragmentary side elevation of a bow sight and bow according to the invention.

FIG. 2 is a similar view showing the bow in an angled position of use as where the archer on an elevated platform is aiming at a target below.

FIG. 3 is an enlarged vertical section taken on line 3—3 of FIG. 1.

FIG. 4 is an enlarged horizontal section taken on line 4—4 of FIG. 1.

FIG. 5 is a vertical section taken on line 5—5 of FIG. 3.

FIG. 6 is an exploded perspective view of the bow sight according to the invention.

DETAILED DESCRIPTION

Referring to the drawings in detail wherein like numerals designate like parts, the hunting bow illustrated includes a hand grip portion 10, above which a mounting element 11 for a bow sight is fixed to the bow. A further mounting bracket 12 having feet 13 is attached as at 14 to the fixed mounting element 11 and includes a dovetail groove 15 for the guidance of a dovetail slide 16 whose movement axis is parallel to the adjacent portion of the bow and longitudinally thereof. The slide 16 is locked in any selected adjusted position by a set screw 17 having a large knurled knob 18 between the bracket 12 and element 11.

The adjustable slide 16 carries a further channel bracket 19 clamped thereon by a side set screw 20 bearing against the slide 16. The channel bracket has a projecting boss 21 provided with a threaded crossbore 22 whose axis is perpendicular to the movement axis of slide 16 and the adjacent portion of the bow. A threaded main pin 23 having an adjusting knob 24 at one end thereof is engaged adjustably in the threaded bore 22 and locked therein in any selected adjusted position by another set screw 24 having threaded engagement with an opening of the boss 21.

The threaded main pin 23 has an axial threaded opening 25 in its end adjacent to the knob 24 receiving a threaded axle pin 26 having a relatively large adjusting knob 27. The axle pin 26 is locked in place by another set screw 28 engaging within a threaded opening 29 formed in the top of a sight pivot bar or mass 30, such as a rectangular cross section elongated bar, as illustrated. The axle pin 26 is received through a transverse pivot opening 31 of the bar 30 near and below its upper end. The axle pin 26 and set screw 28 can be adjusted to render the pivot bar 30 free swinging under the influence of gravity on the axle pin 26, or can be adjusted to lock the bar 30 in an infinite number of angularly adjusted positions around the axis of the axle pin 26.

A very important aspect of the invention comprises the provision of an adjustable and lockable sight pin 32 carrying at its forward end a sight bead 33 preferably surrounded by a ring 34. The sight pin is received adjustably through a transverse opening 35 near and above the lower end of pivot bar 30, the axis of the opening 35 being across the axis of axle pin 26. The sight pin 32 is lockable on the bar 30 in an infinite number of adjusted positions by a bottom locking set screw 36.

It may now be seen that the bow sight has basic vertical adjustment by means of the adjustable and lockable slide 16 and has lateral adjustment through the adjustable threaded main pin 23. With the pivot bar 30 locked or clamped between the two knurled heads 24 and 27 following desired angular adjustment, the bore sight is utilized at ground level by the archer like any other prior art adjustable fixed bead sight.

Additionally, when the archer or hunter is stationed on a platform approximately eight to twenty-five feet above ground level, the bow sight has an important and improved capability as a range finding sight to eliminate guesswork by the hunter in estimating the range while at the elevated position.

To condition the bow sight for this usage, the set screw 28 and axle pin 26 are adjusted to release the bar 30 for free swinging movement about the axis of axle pin 26 from which the bar is depending. The center of gravity of the pivot bar 30 relative to its rotational axis can also be adjusted by moving the sight pin 32 inwardly or outwardly relative to the bar 30 from which it projects and locking the sight pin in the selected position by means of the set screw 36. This adjustment of the center of gravity of the pivot bar 30 is an important feature which enables the bow sight to be utilized on bows of different sizes and strengths and with arrows of different lengths and weights, rather than with only a single bow and arrow combination as in the prior art.

When the various adjustments of the bow sight have been made and the archer is using the bow at the described elevated position with the bar 30 released for free swinging movement under the influence of gravity, the following takes place automatically as the archer aims the arrow at a target on the ground.

If the archer aims at a target at a distance of, say, twenty yards from the elevated platform with the bow inclined to the vertical roughly as shown in FIG. 2, the free swinging sight bead 33 automatically moves outwardly and upwardly relative to the bow and thereby compensates for a change in the trajectory of the arrow and, in effect, finds the proper range for the archer. If the target is only ten yards distant and the bow is further tilted from the vertical, the sight bead 33 will swing further outwardly and upwardly automatically. If aim is taken at a more distant target, say, thirty yards distant, as generally shown in FIG. 1, the sight bead 33 will move upwardly and downwardly relative to the bow to automatically compensate for the change in trajectory, again taking guesswork out of range finding.

The maximum distance for which the bow sight will operate at the elevated station is established when the pivoted bar 30 has moved the sight bead 33 to its lowermost possible position. To enable striking the target at this distance, the archer can adjust the entire sight upwardly or downwardly with the movable slide 16. When the arrow strikes the point at which the bead 33 is aimed, the set screw 17 is securely tightened to lock the vertical slide 16. The archer then aims at a very close distance, and if the arrow strikes high or low, the sight pin 32 is adjusted forwardly or rearwardly to make the necessary correction, following which the set screw 36 is locked tight. The sight is then calibrated or zeroed to be effective at any distance from maximum to minimum.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A bow sight to enable an archer to aim at a target with accuracy from an elevated position or from a ground level position comprising a bow sight pivot element adapted to respond to gravity, means forming an axle and support for the pivot element above the center of gravity of the pivot element and being adjustable to release the pivot element for free swinging about said axle and for locking the pivot element against movement relative to said axle, a sight bead separate from the pivot element, adjustable means carrying the sight bead and engaging the pivot element across the axis of the pivot element and being lockable thereto in any selected position of the sight bead laterally of the pivot element to adjust the center of gravity of the pivot element relative to said axle, and carrier means for the first-named means and being adjustable on two orthogonal axes.

2. A bow sight as defined in claim 1, and the carrier means comprising an adjustable slide, and a cross axis threaded main pin on the slide and adjustable relative thereto.

3. A bow sight as defined in claim 1, and said first-named means comprising a threaded member adapted for engagement adjustably within a threaded opening of said carrier means, and an axle pin coaxial with said threaded member and having threaded engagement therewith, and a pivot element comprising a bar having a pivot opening above said center of gravity and pivotally receiving the axle pin.

4. A bow sight as defined in claim 1, and said adjustable means carrying the sight bead comprising a sight pin, said pivot element having a cross axis bore receiving the sight pin adjustably substantially below said axle pin, and a set screw to lock said sight pin in any selected adjusted position in said cross axis bore.

5. A bow sight as defined in claim 3, and a set screw on said pivot element to lock said axle pin in a selected adjusted position on said threaded member.

6. A bow sight as defined in claim 3, and a set screw on said carrier means to lock said threaded member in a selected adjusted position.

7. A bow sight as defined in claim 1, and said pivot element comprising an elongated bar, the first-named means being engaged with said bar near the upper end of the bar, and said adjustable means carrying the sight bead being engaged with the bar near the lower end of the bar, the bar extending generally vertically during the use of the bow sight.

* * * * *